US007165952B2

(12) United States Patent
Crawford

(10) Patent No.: US 7,165,952 B2
(45) Date of Patent: Jan. 23, 2007

(54) HYDRAULICALLY DRIVEN OIL RECOVERY SYSTEM

(76) Inventor: Joe Crawford, P.O. Box 476, Crane, TX (US) 79731

( * ) Notice: Subject to any disclaimer, the term of this patent is extended or adjusted under 35 U.S.C. 154(b) by 93 days.

(21) Appl. No.: 11/010,641

(22) Filed: Dec. 13, 2004

(65) Prior Publication Data

US 2006/0127226 A1 Jun. 15, 2006

(51) Int. Cl.
*F04B 17/00* (2006.01)

(52) U.S. Cl. ..... 417/405; 417/53; 417/902

(58) Field of Classification Search ..... 417/403, 417/404, 902, 405, 53
See application file for complete search history.

(56) References Cited

U.S. PATENT DOCUMENTS 1,851,801 A * 3/1932 Boone ..... 417/404
2,361,195 A * 10/1944 Grebe ..... 166/307
2,371,704 A * 3/1945 Nichols ..... 91/352
4,403,919 A * 9/1983 Stanton et al. ..... 417/53
2003/0196797 A1 10/2003 Crawford et al.
2006/0000816 A1 1/2006 Crawford
2006/0060358 A1 3/2006 Crawford

* cited by examiner

*Primary Examiner*—Charles G. Freay
(74) *Attorney, Agent, or Firm*—Cox Smith Matthews Incorporated

(57) ABSTRACT

An oil recovery device and method of use where a submersible pump is in combination with a hydraulic motor. The hydraulic motor is actuated by a pressure differential between hydraulic power lines extending between the motor and a regulation means at or near the surface. A monitoring system evaluates, communicates, and records operation parameters so that they may be adjusted to ensure a constant volume or production oil. The device may operate at variable speeds and in reverse.

9 Claims, 2 Drawing Sheets

HYDRAULICALLY DRIVEN OIL RECOVERY SYSTEM

BACKGROUND OF THE INVENTION

1. Field of the Invention

The present invention generally relates to an oil recovery device and method of use. More specifically, the present invention relates to an oil recovery device and method of use whereby a submersible pump is driven by a hydraulic motor.

2. Background Information

The use of oil recovery devices are known in the art. More specifically, oil recovery devices heretofore devised and utilized are known to consist basically of familiar, expected and obvious structural configurations, notwithstanding the myriad of designs encompassed by the crowded prior art which have been developed for the fulfillment of countless objectives and requirements. While these devices may fulfill their respective, particularly claimed objectives and requirements, the aforementioned documents do not disclose an oil recovery system and method of use such as Applicant's present invention.

There is a wide variety of devices used for the recovery of oil. A reason for this is that each different type of pump may be especially beneficial (for one reason or another) for a particular application in the oil recovery process.

A particular type of oil recovery pump is known as a progressive cavity, or "PC," pump. PC pumps are generally characterized by a central, elongated shaft member having a continuous, spiral-type flange spanning the length of the central shaft member. As the central shaft rotates, the associated spiral-type flange rotates and carries recovered oil along the central shaft from bottom to top. The configuration of PC pumps lends itself to the recovery of multi-viscosity oils and is particularly applicable for recovering heavy (low gravity) oil. As will be further discussed, the recovery of "heavy oil" is associated with several types of problems and inefficiencies, the large majority of which are solved or overcome in elegant fashion by Applicant's invention.

Today, submersible oil pumps (those such as PC pumps), are driven by an alternating current "AC" electric motor. This is typically the case as the cumulative resistance along the length of electric cable extending between the surface power source and the downhole pump renders the use of direct current "DC" motors impractical. The use of AC motors presents limitation not yet overcome by known devices. Without the use of variable frequency drives (which use has proven to be impractical), the operating range of these motors is very limited (typically between 55 Hz and 65 Hz for motors known to be used in the art). This limited range necessitates that the motor operate with near constant speed. As will be further described, this type of operation leads to several problems, all of which are overcome by the present device.

Problems associated with recovering heavy oil are often exaggerated during initial stages of operation. For instance, AC motors cannot "ramp up," but instead immediately proceed to running speed. This causes undue acceleration of the surrounding production oil into and through the pump. All too often, the accelerated oil carries solids into the pump where they can become trapped within pump components. The results can be devastating; as trapped solids often cause a complete lock down of the system whereby the device must be removed from the well, repaired at the surface, and then relocated before operation may recommence. In addition, seemingly unavoidable limitations arise as the pump produces and approaches it's intended production and fluid level design parameters. As the oil level descends, the pressure differential between downhole and surface increases, requiring more horsepower to produce the same amount of produced fluid. Because AC motors run at constant speed, they are unable to compensate for falling oil levels to efficiently produce and maintain a desired fluid level and production rate.

Applicant's invention, through a novel combination of component pieces, provides an efficiency in the recovery of oil not available with known devices. For instance, during initial startup, a high fluid level causes the pump to produce at a greater efficiency due to increased pump suction pressure. This allows the produced fluid to surge into the well bore, in some cases bringing unwanted solids. To prevent production surges, the hydraulic motor should be initially operated at relatively low speed. From there, motor speed may gradually "ramp up" to full operation speed. This is thought to be particularly beneficial when used in oil wells containing relatively dense production fluid, or oil having a large amount of solids (such as sand). The gradual increase in motor speed during initial operation provides for a gradual uptake of production oil through the pump. This gradual uptake largely eliminates the influx of solids into the device, thereby providing for increased operating efficiency and longer operating life. In the event that solids are ingested within the device and causes operational problems, the operational direction may easily be reversed. This feature, not available with any known devices, has a tremendously beneficial impact. Rather than having to remove, repair, and reposition the recovery device, the pump direction may be reversed so that any trapped solid becomes dislodged as it is "backed out."

The present invention provides other novel benefits as well. Optimally, as the producing annulus fluid decreases as the pump runs, increased horsepower should be gradually applied to maintain a constant rate and pumping fluid level. With known devices (which operate at constant speed), a compromise has to be made to prevent well from "pumping off" or pumping with a high fluid level. The operational speed of the device may easily be increased in corresponding fashion to maintain a constant production volume or fluid level by increasing the hydraulic power flow at the surface.

The novelty of the present invention is perhaps best understood by way of example. Currently, a university research team is collaborating to solve the very problems mentioned above. This team has invested a tremendous amount of man power and money to solve these problems, yet have been unable to do so. Applicant's invention, through a novel combination of component pieces, provides an elegant solution to the problems mentioned above.

Further, it is well known to those skilled in the art that there is a tremendous amount of underground heavy oil that cannot be produced with economic efficiency in view of the problems mentioned above. Currently, Canada is believed to have the largest known reserve of heavy oil in the world; however, production is not feasible with known technology. Applicant's invention, however, is believed to overcome known problems with such efficiency that production should commence in wells with even the "heaviest oil."

In view of the problems associated with known recovery devices and methods, a great need exists for an oil recovery device that can withstand the rigors of recovering oil containing a relatively large amount of solid matter. Applicant's invention provides such a device and method. That is, the present invention is capable of variable speed and reversible operation. As such, oil can be gradually accelerated through a submersible pump and solids that become trapped in pump components can be "backed out" and allowed to redistribute away from the pump.

SUMMARY OF THE INVENTION

The general purpose of the present invention, which will be described subsequently in greater detail, is to provide a new oil recovery device and method of use which has many of the advantages of such devices and methods known in the art and many novel features that result in a new device and method of recovery which is not anticipated, rendered obvious, suggested, or even implied by any of the known devices or methods of recovery, either alone or in any combination thereof.

In view of the foregoing, it is an object of the present invention to provide an oil recovery device and method of use that uses a hydraulic motor.

It is another object of the present invention to provide an oil recovery device and method of use that eliminates the required use of electric motors.

It is another object of the present invention to provide an oil recovery device and method of use that operates at variable rotations per minute (RPM's).

It is another object of the device to provide an oil recovery device and method of use that has variable horsepower input.

It is another object of the present invention to provide an oil recovery device and method of use that will limit shut down and startup operations.

It is another object of the present invention to provide an oil recovery device and method of use that may operate in forward or reverse mode.

It is another object of the present invention to provide an oil recovery device and method of use that has a systematic evaluation mechanism.

In satisfaction of these and other related objectives, the present invention provides a hydraulically driven oil recovery device and method of use that is particularly beneficial for the recovery of low gravity oil, having the tendency to move unwanted solids, and high volume lift applications. The device is characterized by a hydraulic motor in combination with a submersible pump, which extends from a coiled tubing production tube as known in the art. The submersible pump and hydraulic motor combination operate within an oil well production casing. Although not an exclusive requirement, in its most preferred and efficient form, the submersible pump is a progressive cavity "PC" pump and the hydraulic motor is a variable speed motor having a diameter of four inches or as dictated by the I. D. of the production casing. Other multistage pumps are applicable to this technology, but the greatest efficiency should be realized in the "PC" style pump.

Preferably, the hydraulic motor is able to operate at variable speeds and reverse operational direction. A variable speed type hydraulic motor is generally preferred as such may be adjusted in order to maintain constant volume and fluid level of produced oil. The hydraulic motor is driven by hydraulic fluid circulating through differential hydraulic coiled tubing power lines. Both hydraulic lines run inside the length of the production tube and submersible pump and is afforded protection by an outer housing.

Each hydraulic power line extends between a hydraulic fluid circulation means 44 (at or near the surface) and the hydraulic motor (down hole). Circulation means 44 serves to generate fluid pressure responsible for actuation of motor 14. The hydraulic motor may be variably actuated by the differential hydraulic pressure between each hydraulic power line, sheave changes, or a variable speed motor. In addition, the present invention has a monitoring system that is able to evaluate, communicate, and record the volume of oil being produced. As such, the operational parameters of the device may be adjusted to ensure a constant volume of produced oil while maintaining a constant producing level to maximize pump efficiency.

During operation, actuation of the hydraulic pump causes actuation of the submersible pump. Preferably, a centrally aligned drive shaft extending along the length of the submersible pump rotates. A series of pump rotors surround the drive shaft and span a substantial length of the drive shaft in spiral-like fashion. Rotation of the drive shaft causes a corresponding rotation of the rotors such that production fluid is taken in through a pump inlet and a series of lateral inlets and "lifted" along the length of the drive shaft After its journey through the submersible pump, the oil enters the production tubing where it makes its way to the surface.

BRIEF DESCRIPTION OF THE DRAWINGS

Applicant's invention may be further understood from a description of the accompanying drawings, wherein unless otherwise specified, like referenced numerals are intended to depict like components in the various views.

DETAILED DESCRIPTION OF THE PREFERRED EMBODIMENT

Figure 1:
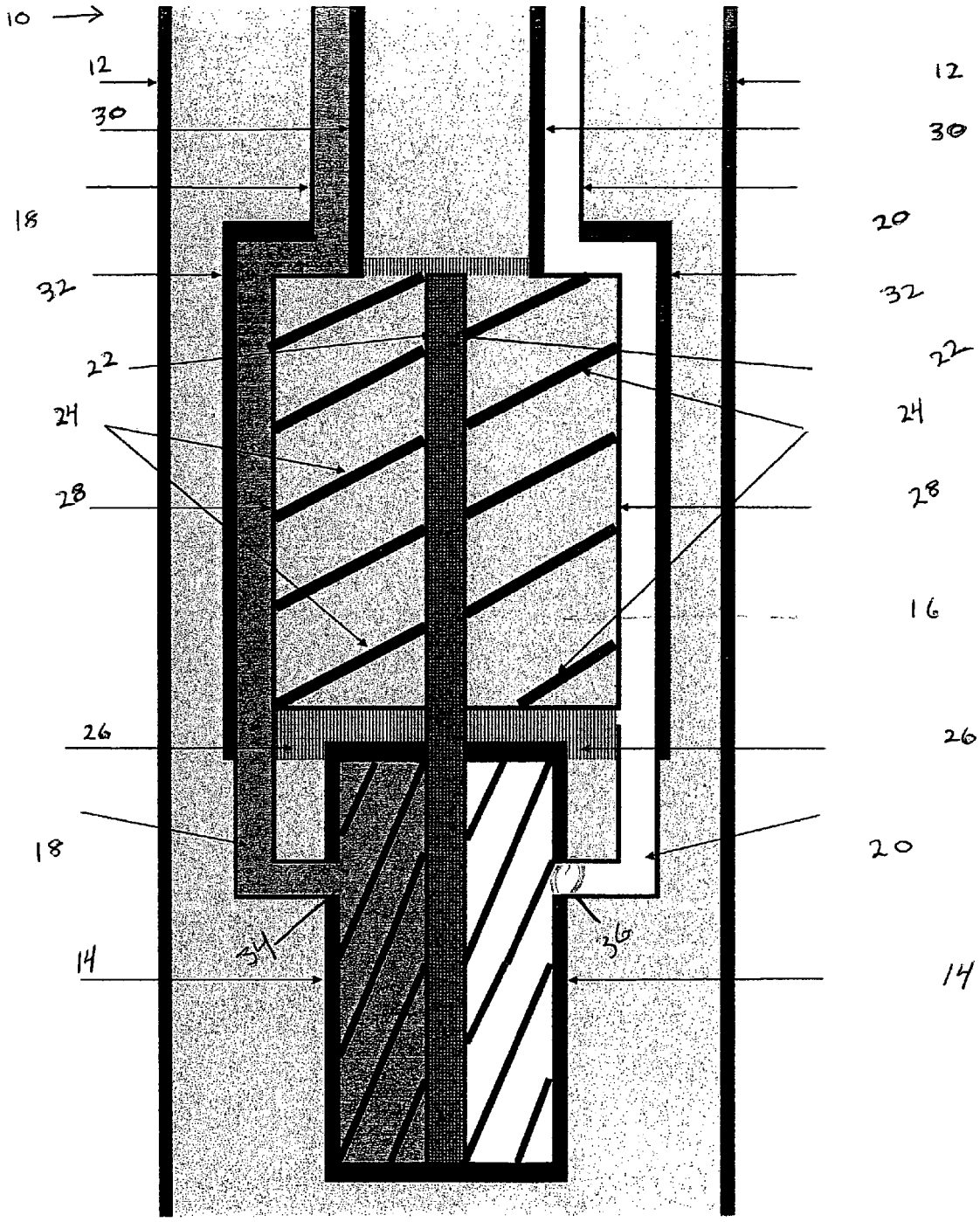
FIG. 1 is a cross section view of the preferred embodiment of the hydraulically driven oil recovery device of the present invention.
Figure 2:
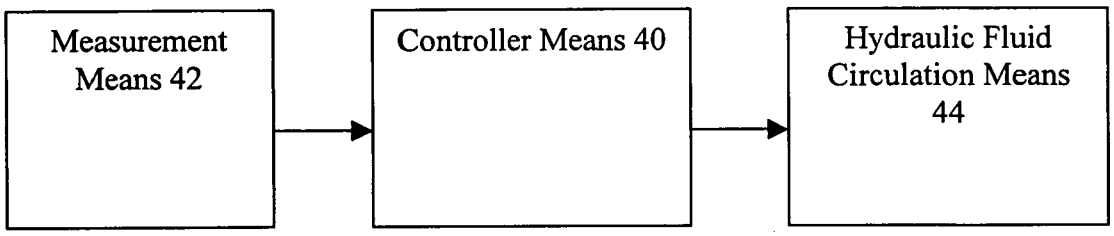
FIG. 2 is a flow chart type diagram of the preferred embodiment of the present invention.

Referring to FIG. 1, the device of the present invention is generally designated by reference numeral 10. Device 10 is envisioned as being most beneficially used when placed 16 downhole in an oil well production casing. Referring to FIG. 1, such oil well production 17 casing is designated by reference numeral 12.

Device 10 is characterized by hydraulic motor 14 located at the downhole side of a submersible pump 16, which extends from production tubing 30. Hydraulic motor 14, in the preferred embodiment, is of a dimension suitable for placement within a standard sized oil well (usually of a diameter of four inches or less) and preferably of a variable-speed type hydraulic motor actuated by differential fluid pressure. As will be later discussed, a variable speed type hydraulic motor 14 is generally preferred as such may be adjusted in order to maintain constant volume of produced oil.

In the most preferred embodiment, hydraulic motor 14 is driven by hydraulic fluid circulating through hydraulic power line high side 18 and hydraulic power line low side 20. Each hydraulic line runs along the length of production tube 30 in adjacent fashion and extends along the length of submersible pump 16 where each is positioned between the peripheral surface of pump 16 and housing 32. Housing 32 surrounds a substantial portion of submersible pump 16 and hydraulic power lines 18 and 20, and is meant to protect and hold each in relation to one another.

At or near the surface, hydraulic power line 18 and hydraulic power line 20 are in combination with some power fluid circulating means as known in the art. At its downhole end, hydraulic line 18 terminates at hydraulic motor 14 at high side inlet 34; and, at its downhole end, hydraulic line 20 terminates at hydraulic motor 14 at low side inlet 36. Hydraulic motor 14 is actuated by a pressure differential between hydraulic power line high side 18 and hydraulic power line low side 20. Importantly, as this pressure differential is changed, the speed of hydraulic motor 14 is changed. The particular hydraulic mechanism responsible for the actuation of hydraulic motor 14 is not critical; certainly, other suitable means for acting motor 14 will be apparent to those skilled in the art.

Hydraulic motor 14 is in combination with submersible pump 16 such that actuation of motor 14 causes actuation of pump 16. As mentioned, in the preferred embodiment, submersible pump 16 is of a progressive cavity type pump as known in the art. These types of pumps are well known and are currently known to be manufactured by E.S.P., SCHLUMBERGER, BAKER CENTRILIFT, and WEATHERFORD PRODUCTION SYSTEMS. However, other useful embodiments are envisioned (and certainly will be apparent to those skilled in the art) where submersible pump 16 is of some other type of pump. For example, other embodiments are envisioned where pump 16 is a multi-stage centrifugal pump as known in the art—these pumps are widely used in both water and oil wells.

As such, referring to FIG. 1, hydraulic motor 14 is shown in combination with a general progressive cavity type submersible pump 16. Actuation of pump 14 cause rotation of a central pump drive shaft 22. Drive shaft 22 is centrally aligned along submersible pump 16 and extends along the length thereof. Extending from drive shaft 22 are pump rotors 24. Pump rotors 24 span a substantial length of drive shaft 22 in spiral-like fashion. Rotation of drive shaft 22 causes a corresponding rotation of rotors 24 such that production fluid is taken in through pump inlet 26 and a series of lateral inlets (not pictured) and "lifted" along the length of drive shaft 22. Upon being lifted through submersible pump 16 the oil enters production tubing 30 where it travels to the surface to be processed in any number of ways known in the art.

As previously mentioned, and to be discussed in further detail, progressive cavity pumps are particularly useful for, and traditionally used in, oil wells containing relatively low gravity oil, and in high volume lift situations. However, these pumps are not without drawbacks. Known progressive cavity pumps operate with very small tolerances so that a fluid-tight seal is formed between pump rotor 24 and pump stator 28; as such, these pumps often "lock up" when sand or other solids get caught between component parts (usually the rotor and stator). When these pumps are driven by alternating current ("AC") electric motors, as all such known pumps are, such a lock up requires complete device shutdown. That is, the pumps have to be stopped, removed from the oil well, repaired, and then repositioned within the well.

Applicant's invention provides a novel solution to the previously mentioned problems. For instance, during initial operation, the pressure gradient between downhole and surface is at minimum. To prevent production surges, hydraulic motor 14 may be initially operated at relatively low speed. From there, motor speed may gradually "ramp up" to full operation speed. As mentioned, Applicant's invention is thought to be particularly beneficial when used in oil wells containing relatively dense production fluid, or oil having a large amount of solids (such as sand). The gradual increase in motor speed during initial operation provides for a gradual uptake of production oil through pump inlet 26 and lateral inlets (not pictured), through submersible pump 16. This gradual uptake largely eliminates the influx of solids into submersible pump 16 thereby providing for increased operating efficiency and longer operating life. In the event some solids are ingested within submersible pump 16 and causes operational problems, the direction of hydraulic motor 14 may easily be reversed. This is accomplished simply by reversing hydraulic power line high side 18 and hydraulic line low side 20 to cause an opposite or "negative" pressure differential about hydraulic motor 14. This feature, while not available with any known devices, has a tremendously beneficial impact. Rather than having to remove, repair, and reposition the submersible pump 16, the pump direction may be reversed so that any trapped solid becomes dislodged as it is "backed out." At this point, the device may set still while the solids redisperse, or, the system may begin normal operation in gradual fashion in an attempt to pass the solid.

Use of hydraulic motor 14 provides other novel benefits as well. As oil is produced, the level of oil remaining in the well decreases; as such, the pressure gradient between downhole and surface increases. When these pumps are driven by AC electric motors, as all such known pumps are, production falls off with a decrease in production efficiency associated with the declining fluid level. This decease is rooted in the constraint that the electric motor maintains constant speed and power. It cannot accelerate or increase power to compensate for decreased downhole pressure. However, Applicant's invention avoids this limitation. The speed of hydraulic motor 14 may easily be increased in corresponding fashion to maintain a constant production volume.

Efficient operation of the present device is bolstered by complimentary components put in place to evaluate operation of the system and the produced oil. That is, in the preferred embodiment, controller means 40 serves to evaluate the operation of the device against a series of selected operational parameters. Preferably, although not exclusively, controller means 40 would work from differential amps to motor 14 and pump 16. In this fashion, pump 16 may start on a preset "slow power" setting and gradually ramp up to desired production parameters. As the fluid level descends in the well bore, additional power is necessary to produce the same volume of fluid (due to the increase in differential at surface and downhole). Necessary power (probably measured in amps load) should correlate to producing fluid level and producing volumes. Finally, production volumes can be measured by measurement mean 42. Measurement means 42 may be any of several types as known in the art, such as a differential flow meter produced by companies such as HALIBURTON and EDI. General operation of the preferred embodiment involves information received at measurement means 42 being sent to controller means 40. Controller means 40 may then carry out any number of functions (i.e., evaluate, compare, and record production volume and other parameters; adjust operation of hydraulic fluid circulating means 44) to better manage the operation of the device.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A fluid pumping system comprising:

a fluid pressure differential motor, which by elongate conduit means, is in substantially sealed fluid communication with remote pressure generation means configured for driving said fluid pressure differential motor;

a pump which is mechanically engaged with said fluid pressure differential motor by means of a drive shaft centrally aligned along said pump;

wherein actuation of said fluid pressure differential motor causes rotation of said drive shaft; and wherein said pump is configured for placement in fluid communication with a subterranean fluid source and for conveyance of fluid front said subterranean fluid source substantially to a surface elevation.

2. The system of claim 1 wherein said fluid differential motor and said pump are operable in first and second opposing modes whereby, when said fluid differential motor and said pump are changed from one of said modes to the other said mode, said pump reverses fluid egress and ingress circuits, and further comprising control means for controlling said pressure generation means to alternatively convey pressurized fluid to said pressure differential motor for respectively effecting said first and second opposing modes of operation of said pump.

3. The system of claim 2 further comprising a measurement means in communication with said control means and configured for measuring said conveyed fluid.

4. A method for pumping fluid comprising the steps of:

selecting a fluid pumping system comprising a fluid pressure differential motor, which by elongate conduit means, is in substantially sealed fluid communication with remote pressure generation means configured for driving said fluid pressure differential motor;

a pump which is mechanically engaged with said fluid pressure differential motor by means of a drive shaft centrally aligned along said pump;

wherein actuation of said fluid pressure differential motor causes rotation of said drive shaft; and wherein said pump is configured for placement in fluid communication with a subterranean fluid source and for conveyance of fluid from said subterranean fluid source substantially to a surface elevation, positioning said fluid pumping system to effectively pump said fluid;

initiating operation of said fluid pumping system.

5. A method for pumping fluid comprising the steps of:

selecting a fluid pumping system comprising a fluid pressure differential motor, which by elongate conduit means, is in substantially sealed fluid communication with remote pressure generation means configured for driving said fluid pressure differential motor;

a pump which is mechanically engaged with said fluid pressure differential motor by means of a drive shaft centrally aligned along said pump;

wherein actuation of said fluid pressure differential motor causes rotation of said drive shaft; and wherein said pump is configured for placement in fluid communication with a subterranean fluid source and for conveyance of fluid from said subterranean fluid source substantially to a surface elevation;

wherein said fluid differential motor and said pump are operable in first and second opposing modes whereby, when said fluid differential motor and said pump are changed from one of said modes to the other said mode, said pump reverses fluid egress and ingress circuits, and further comprising control means for controlling said pressure generation means to alternatively convey pressurized fluid to said pressure differential motor for respectively effecting said first and second opposing modes of operation of said pump;

positioning said fluid pumping system to effectively pump said fluid;

initiating operation of said fluid pumping system.

6. An oil recovery device comprising a hydraulic motor configured for placement and operation in an oil well and in combination with a submersible pump, where said hydraulic motor is actuated by a motor actuation means;

wherein said submersible pump is mechanically engaged with said hydraulic motor by means of a drive shaft centrally aligned along said submersible pump;

wherein actuation of said hydraulic motor causes rotation of said drive shaft;

said submersible pump configured for placement and operation in an oil well, having one or more inlets and one or more outlets allowing for the ingress and egress of said oil, and in combination with said hydraulic motor where actuation of said hydraulic motor causes actuation of said pump;

said motor actuation means further comprising a hydraulic fluid circulation means, and one or more elongate members extending between said motor and said hydraulic fluid circulation means, and configured for containing hydraulic fluid therein and the transfer of hydraulic fluid there through.

7. The oil recovery device of claim 6 further comprising a controller means in communication with said motor actuation means.

8. The oil recovery device of claim 7 further comprising:

a measurement means in communication with said controller means.

9. A method for recovering oil comprising the steps of:

selecting an oil recovery device comprising:

a hydraulic motor configured for placement and operation in an oil well and in combination with a submersible pump, where said hydraulic motor is actuated by a motor actuation means;

wherein said submersible pump is mechanically engaged with said hydraulic motor by means of a drive shaft centrally aligned along said submersible pump;

wherein actuation of said hydraulic motor causes rotation of said drive shaft;

said submersible pump configured for placement and operation in an oil well, having one or more inlets and one or more outlets allowing for the ingress and egress of said oil, and in combination with said hydraulic motor where actuation of said hydraulic motor causes actuation of said pump;

said motor actuation means further comprising a hydraulic fluid circulation means, and one or more elongate members extending between said motor and said hydraulic fluid circulation means, and configured for containing hydraulic fluid therein and the transfer of hydraulic fluid there through;

a controller means in communication with said motor actuation means; and a measurement means in communication with said controller means;

positioning said oil recovery device to effectively recover said oil from an oil well;

initiating operation of said oil recovery device.

* * * * *